US008327654B2

(12) United States Patent
Taylor

(10) Patent No.: US 8,327,654 B2
(45) Date of Patent: Dec. 11, 2012

(54) CONDENSER, RADIATOR, AND FAN MODULE WITH RANKINE CYCLE FAN

(75) Inventor: Dwayne Robert Taylor, Livonia, MI (US)

(73) Assignee: DENSO International America, Inc., Southfield, MI (US)

( * ) Notice: Subject to any disclaimer, the term of this patent is extended or adjusted under 35 U.S.C. 154(b) by 1276 days.

(21) Appl. No.: 12/077,180

(22) Filed: Mar. 17, 2008

(65) Prior Publication Data

US 2009/0229266 A1 Sep. 17, 2009

(51) Int. Cl.
*F25B 27/00* (2006.01)
*B60H 1/00* (2006.01)
*B60H 1/32* (2006.01)

(52) U.S. Cl. ..... 62/238.4; 165/43; 62/239; 62/244; 62/323.4; 60/614; 60/618; 60/651; 60/670; 60/693

(58) Field of Classification Search ..... 165/41, 165/42, 43, 44, 51, 137, 140; 62/235.1, 238.4, 62/239, 244, 259.2, 323.4; 60/614, 618, 60/651, 670, 693; 290/2, 4 C, 4 R; 237/12.1
See application file for complete search history.

(56) References Cited

U.S. PATENT DOCUMENTS 2,658,357 A * 11/1953 Smith ..... 165/140
2,962,873 A * 12/1960 Anderson ..... 62/239
3,070,975 A * 1/1963 Cornelius ..... 62/244
3,219,831 A * 11/1965 Ray et al. ..... 290/2
3,620,008 A * 11/1971 Newbold ..... 62/238.4
4,010,378 A * 3/1977 Tharpe et al. ..... 62/236
4,031,705 A * 6/1977 Berg ..... 123/41.19
4,103,493 A * 8/1978 Schoenfelder ..... 62/235.1
4,295,606 A * 10/1981 Swenson ..... 237/12.1
4,342,200 A * 8/1982 Lowi, Jr. ..... 62/238.4
4,391,100 A * 7/1983 Smith ..... 60/693
4,425,763 A * 1/1984 Porta et al. ..... 60/693
4,490,619 A * 12/1984 McMinn ..... 290/2
4,526,013 A * 7/1985 Joy ..... 62/238.4
4,570,077 A * 2/1986 Lambley ..... 290/4 C
4,586,338 A * 5/1986 Barrett et al. ..... 60/618
4,590,384 A * 5/1986 Bronicki ..... 290/4 C
4,827,152 A * 5/1989 Farkas ..... 290/4 R
4,920,276 A * 4/1990 Tateishi et al. ..... 290/2
5,009,262 A * 4/1991 Halstead et al. ..... 165/140
(Continued)

FOREIGN PATENT DOCUMENTS

JP 61-155614 7/1986
JP 4-224228 8/1992

*Primary Examiner* — Ljiljana Ciric
(74) *Attorney, Agent, or Firm* — Harness, Dickey & Pierce, P.L.C.

(57) ABSTRACT

An apparatus to rotate a cooling fan may employ an engine coolant radiator having a radiator inlet tank attached at an end of the radiator. The radiator inlet tank may be filled with engine coolant and transfer heat into a fan system evaporator contained inside the radiator inlet tank. The tank may contain a liquid working fluid capable of absorbing heat from the engine coolant and becoming a gaseous working fluid. A gas expander with an impeller may be employed to receive the gaseous working fluid from the fan system evaporator and impart rotation in a shaft to which the impeller of the gas expander and cooling fan is attached. A fan system condenser may receive the gaseous working fluid from the gas expander and condense the gaseous working fluid to form a liquid working fluid. A pump pumps the liquid working fluid back to the fan system evaporator.

18 Claims, 4 Drawing Sheets

U.S. PATENT DOCUMENTS 5,036,910 A * 8/1991 Wolf ..... 165/140
5,078,206 A * 1/1992 Goetz, Jr. ..... 165/41
5,080,167 A * 1/1992 Wolf ..... 165/140
5,090,371 A 2/1992 Schäpertöns et al.
5,172,752 A * 12/1992 Goetz, Jr. ..... 165/41
5,351,487 A * 10/1994 Abdelmalek ..... 60/618
5,477,687 A * 12/1995 Horn ..... 62/323.4
5,860,279 A 1/1999 Bronicki et al.
5,896,746 A * 4/1999 Platell ..... 60/618
6,124,644 A * 9/2000 Olson et al. ..... 290/2
6,205,803 B1 * 3/2001 Scaringe ..... 165/140
6,234,400 B1 * 5/2001 Guyer ..... 237/12.1
6,598,397 B2 * 7/2003 Hanna et al. ..... 60/651
6,729,137 B2 * 5/2004 Filippone ..... 60/618
6,732,525 B2 * 5/2004 Endoh et al. ..... 60/618
6,751,959 B1 * 6/2004 McClanahan et al. ..... 60/670
6,796,367 B2 * 9/2004 Blacquiere et al. ..... 62/244
6,798,079 B2 * 9/2004 Nelson et al. ..... 290/2
6,845,618 B2 * 1/2005 Niikura et al. ..... 60/618
6,910,333 B2 * 6/2005 Minemi et al. ..... 60/618
6,913,068 B2 * 7/2005 Togawa et al. ..... 165/51
6,986,385 B1 * 1/2006 Gilles et al. ..... 165/43
7,051,787 B2 * 5/2006 Taguchi ..... 165/51
7,097,925 B2 * 8/2006 Keefer ..... 429/9
7,152,407 B2 * 12/2006 Jobson ..... 60/614
7,152,422 B2 * 12/2006 Takano et al. ..... 62/238.6
7,181,919 B2 * 2/2007 Uno et al. ..... 62/157
7,258,086 B2 * 8/2007 Fitzgerald ..... 60/517
7,466,034 B2 * 12/2008 Kang et al. ..... 290/40 C
7,508,666 B1 * 3/2009 Henneberg et al. ..... 62/259.2
7,564,685 B2 * 7/2009 Clidaras et al. ..... 62/259.2
7,630,795 B2 * 12/2009 Campbell et al. ..... 62/259.2
7,639,499 B1 * 12/2009 Campbell et al. ..... 62/259.2
7,730,731 B1 * 6/2010 Bash et al. ..... 62/259.2
7,735,335 B2 * 6/2010 Uno et al. ..... 62/467
7,748,226 B2 * 7/2010 Iwanami et al. ..... 62/236
7,841,306 B2 * 11/2010 Myers et al. ..... 60/670
2003/0147214 A1 * 8/2003 Patel et al. ..... 62/259.2
2004/0025501 A1 * 2/2004 Endoh et al. ..... 60/320
2004/0060320 A1 * 4/2004 Roh et al. ..... 62/259.2
2005/0173097 A1 * 8/2005 Kitajima et al. ..... 62/259.2
2008/0060373 A1 * 3/2008 Campbell et al. ..... 62/259.2
2008/0123297 A1 * 5/2008 Tilton et al. ..... 62/259.2
2009/0260384 A1 * 10/2009 Champion et al. ..... 62/259.2

* cited by examiner

CONDENSER, RADIATOR, AND FAN MODULE WITH RANKINE CYCLE FAN

FIELD

The present disclosure relates to an automotive condenser, radiator and fan module with a Rankine cycle fan. More specifically, the disclosure relates to driving such a cooling fan with a liquid and gaseous coolant.

BACKGROUND

The statements in this section merely provide background information related to the present disclosure and may not constitute prior art. Internal combustion engines, regardless of whether they are gasoline powered or diesel powered, typically generate high quantities of heat during operation due to the combustion process. The generated heat is typically removed from the engine, and the air surrounding the engine, or at least reduced to prevent the engine from overheating and to permit the engine to operate more efficiently. Such heat removal may be accomplished by an engine driven cooling fan that is driven directly by a fan pulley that is turned by an engine crankshaft which spins as a result of combustion. Alternatively, an electric cooling fan may be driven by electricity from a battery that is charged by an alternator, which is coupled to an engine driven pulley using a belt. Thus, engine driven cooling fans and electrical fans both possess the limitation of requiring energy from internal combustion that might otherwise be utilized to move a vehicle, thus detracting from a vehicle's efficiency, such as its overall fuel economy, or miles per gallon (mpg).

Another limitation is that the speed of an engine driven cooling fan is typically controlled by the speed of the engine (rpm), and not the temperature of the engine. Still yet, another limitation of engine driven cooling fans and electric fans is that they each may require the use of additional engine pulleys and additional lengths of belt to drive such a pulley thus resulting in increased overall noise, vibration and harshness detectable within a vehicle cabin. Such noise, vibration and harshness detracts from overall ride quality experienced by vehicle occupants.

What is needed then is a device that does not suffer from the above limitations. This, in turn, will result in a cooling device and method of cooling that utilizes heat from an internal combustion engine to drive the cooling device to remove heat from the engine.

SUMMARY

An apparatus to drive or rotate a cooling fan may employ an engine coolant radiator having a radiator inlet tank attached at a first end of the radiator. The radiator inlet tank may be filled with an engine coolant such as water or antifreeze. A fan system evaporator may be entirely contained inside the radiator inlet tank and contain a liquid working fluid capable of absorbing heat from the engine coolant and becoming a gaseous working fluid. A gas expander with an impeller may be employed to receive the gaseous working fluid from the fan system evaporator and impart rotation in a shaft to which the impeller of the gas expander is attached. A fan system condenser may receive the gaseous working fluid from the gas expander and condense the gaseous working fluid to form a liquid working fluid. A pump may receive the liquid working fluid from an opposite end of the fan system condenser from which the working fluid entered as a gas and pump the liquid working fluid into the fan system evaporator.

A single cooling fan driven by the expander may draw air through the fan system condenser and an air conditioning condenser. A single shaft may be coupled to the cooling fan and the pump while the shaft is coupled to and driven by the gas expander. The gas expander and the pump may be contained within a common housing and coupled to the shaft by welding, screws, or other fastening method.

An electric cooling fan may be arranged such that the electric cooling fan pushes air through the fan system condenser and the air conditioning condenser. An air conditioning condenser may be positioned relative to the fan system condenser such that the electric cooling fan draws air through both condensers in a parallel or a series fashion.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses. Description of a Condenser-Radiator-Fan Module (CRFM) with a Rankine Cycle Fan will be made with reference to FIGS. 1-6. The Rankine cycle is a thermodynamic cycle that converts heat into work. Such heat is acquired from a source external to the Rankine cycle, which is a closed loop heat engine. The present disclosure utilizes a Rankine cycle to take advantage of its efficiency in utilizing at least one outside heat source in the cycle.

Figure 1:
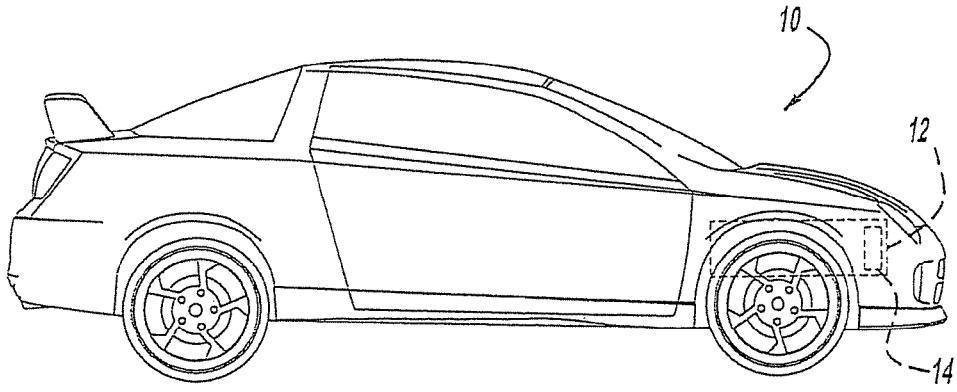
FIG. 1 is a side view of a vehicle depicting the general location of an engine.

FIG. 1 depicts a vehicle, such as an automobile 10, in which an engine 12, such as a diesel or gasoline engine, undergoes internal combustion and generates heat as a result of such combustion. To remove the heat generated by the internal combustion of the engine, a condenser, radiator, and fan module 14 (CRFM 14) may be utilized, in accordance with the present disclosure.

Figure 2:
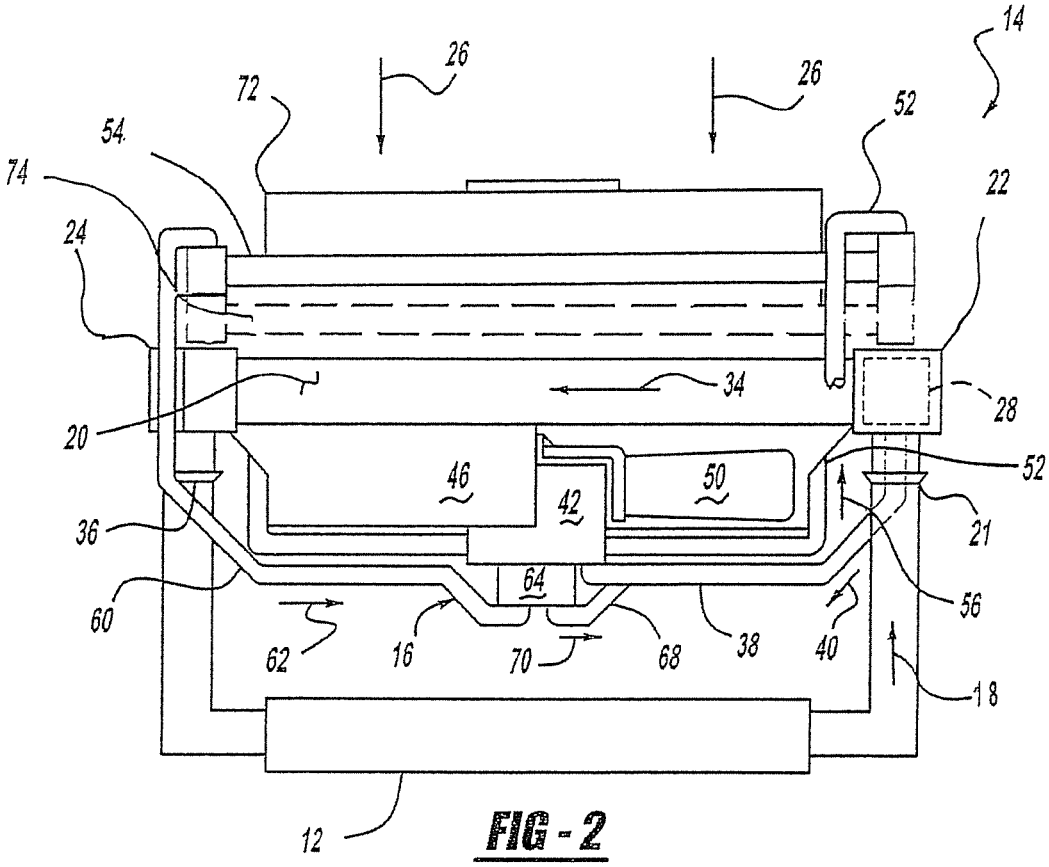
FIG. 2 is a top view of a condenser, radiator and fan module in accordance with the present disclosure.
Figure 3:
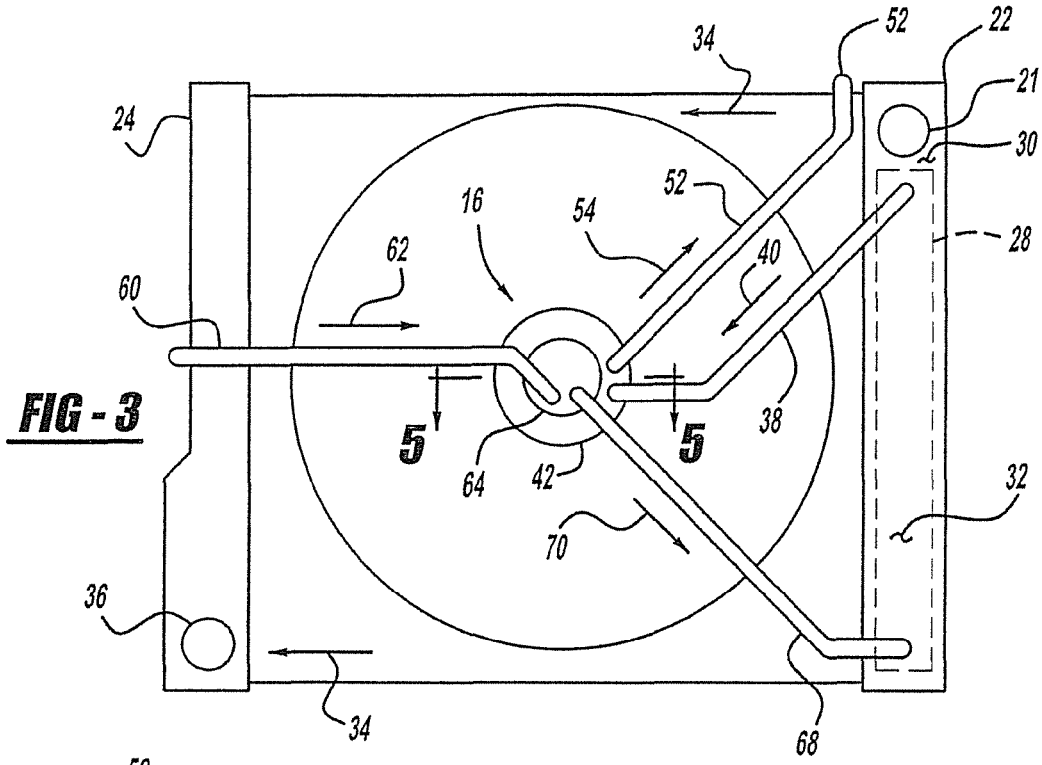
FIG. 3 is a rear view of a condenser, radiator and fan module in accordance with the present disclosure.
Figure 4:
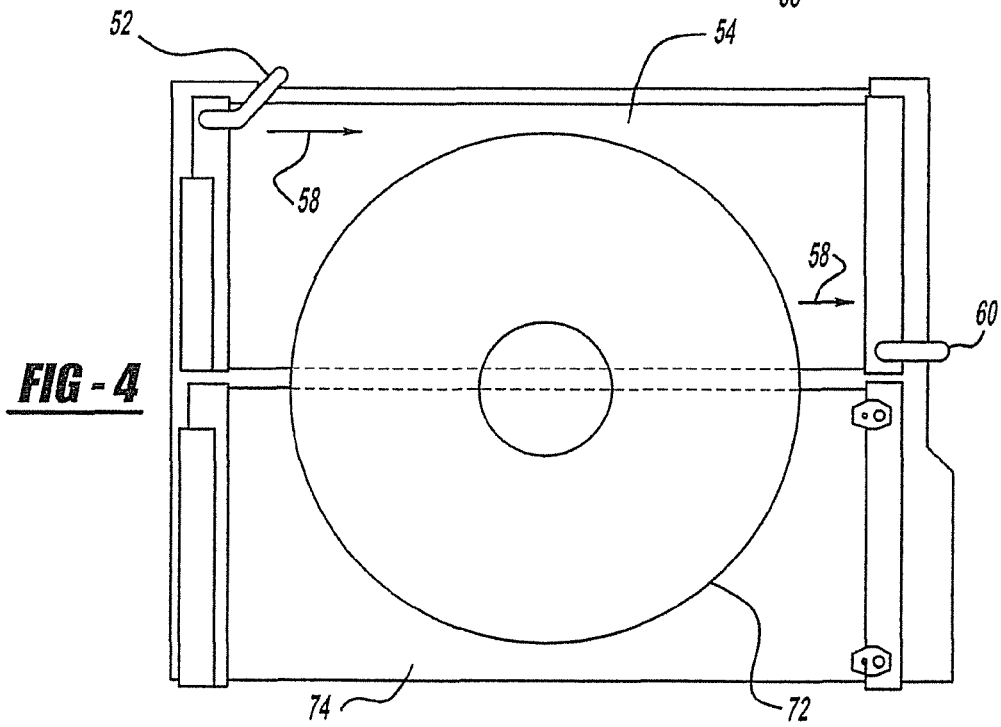
FIG. 4 is a front view of a condenser, radiator and fan module in accordance with the present disclosure.
Figure 5:
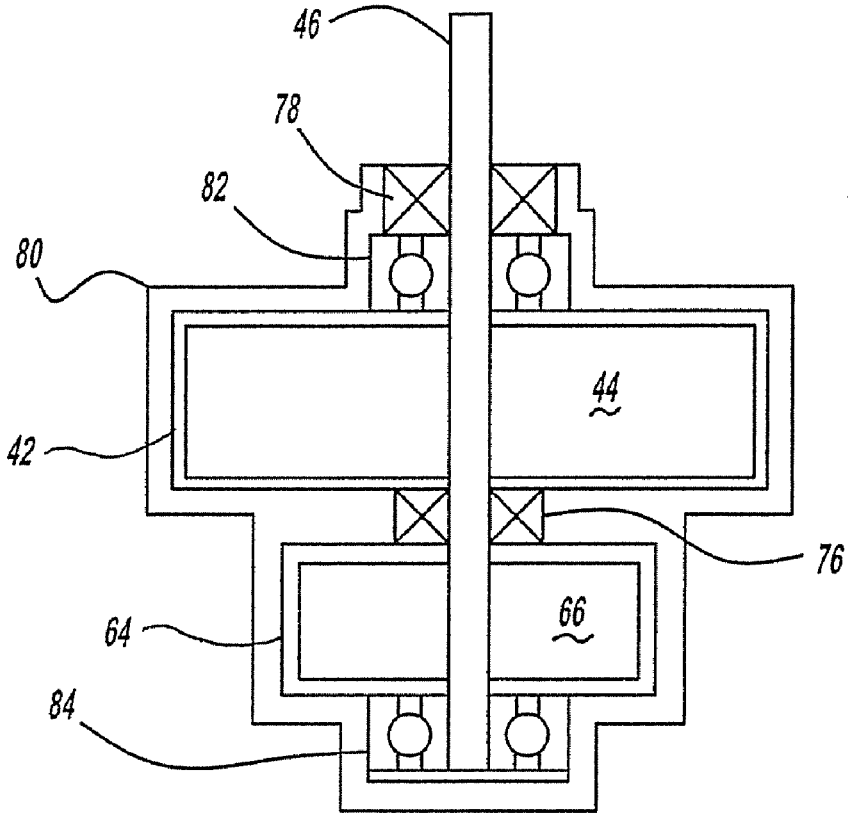
FIG. 5 is a cross-sectional view of an expander and pump assembly in accordance with the present disclosure.

Proceeding with the inclusion of FIGS. 2-5, FIG. 2 depicts a top view of the CRFM 14, FIG. 3 depicts a rear view of the CRFM 14, FIG. 4 depicts a front view of the CRFM 14, and FIG. 5 depicts a cross-sectional view of an expander and pump assembly 16. Continuing with FIG. 2, in accordance with arrow 18, hot engine coolant, such as water or an antifreeze mixture, flows from the engine block of engine 12 and into the radiator 20, also known as the radiator core 20, by way of a radiator inlet 21 and subsequently into the radiator inlet tank 22, which is connected to the radiator 20, such as through brazing or welding. Once in the radiator 20, the hot engine coolant flows across the radiator 20 toward the radiator outlet tank 24. With the hot engine coolant flowing within and across the interior of the radiator 20, heat is removed from the hot engine coolant by airflow 26 that passes, generally perpendicularly, through the radiator 20 and the entire CRFM 14 assembly.

Continuing with the operative workings of the CRFM 14, before the hot engine coolant begins to cool, heat from the hot engine coolant in the radiator inlet tank 22 is transferred into the working fluid within the fan system evaporator 28 through the wall of the fan system evaporator 28. As depicted in FIGS. 2 and 3, the fan system evaporator 28 is located within the radiator inlet tank 22. Furthermore, to facilitate heat transfer from the engine coolant within the radiator inlet tank 22 to the working fluid of the fan system evaporator 28, the fan system evaporator 28 may be located or situated within the radiator inlet tank 22 such that he fan system evaporator 28 is completely surrounded by engine coolant of the engine coolant area 30 or at least substantially surrounded by engine coolant of the engine coolant area 30. In conjunction with the explanation above, as the engine coolant enters the radiator inlet 21, the engine coolant moves across and within the radiator 20 in accordance with arrow 34 before passing out of the radiator outlet 36 of the radiator outlet tank 24.

Upon heat being transferred from the engine coolant of the engine coolant area 30 of the radiator inlet tank 22 into the working fluid of the working fluid area 32 of the fan system evaporator 28, the fan system of the current disclosure may be further explained. Continuing, the heated working fluid, which as stated above may be a hydrofluorocarbon such as R134a. Regardless of the working fluid, the working fluid must be capable of vaporization and condensation within the pressures and temperatures that the fan system experiences or undergoes during it operation. Before the working fluid absorbs heat from the liquid engine coolant in the radiator inlet tank 22, the working fluid is a liquid. Upon absorbing heat from the liquid engine coolant, the working fluid becomes a gas and then exits the fan system evaporator 28 via the expander inlet tube 38 and flows in accordance with arrow 40. Once in the expander inlet tube 38, the gaseous working fluid flows toward and into an expander 42 of an expander and pump assembly 16, which may be disposed at the center or proximate the center of the radiator 20, when viewed from the front or rear of the radiator 20.

Continuing with FIGS. 2-5, the gaseous working fluid enters the expander 42 at a high pressure, for example 20.75 MPa, and then exits the expander 42 at a lower pressure, for example 1.0 MPa, which causes the expander impeller 44 to rotate. Because the expander impeller 44 is connected to the fan shaft 46, the fan shaft 46 rotates with the expander impeller 44. Rotation of the fan shaft 46 causes rotation of the main cooling fan 50. The expander may be of a scroll construction, vane construction or other suitable construction.

The relatively low pressure gaseous phase fan system working fluid exits the expander 42 and flows to the fan system condenser 54 via an expander outlet tube 52 in accordance with arrow 55. FIG. 2 depicts the expander outlet tube 52 as broken for ease of viewing. FIG. 3 better depicts the expander outlet tube 52. As the working fluid flows through the fan system condenser 54, heat is removed from the fan system working fluid because the airflow 26 passes through the fan system condenser 54. As heat is removed from the gaseous working fluid as the gaseous working fluid passes across, through and within the fan system condenser 54 in accordance with arrow 58, the working fluid changes phase and becomes a liquid. The liquid working fluid then exits the fan system condenser 54 and flows into and through the pump inlet pipe 60 in accordance with the arrow 62 and into the fan system pump 64. The fan system pump impeller 66 is mounted to the same shaft 46 as the expander impeller 44 and receives its rotational motion from the shaft 46. The liquid phase fan system working fluid then flows back into the fan system evaporator 28 via the pump outlet tube 68 in accordance with arrow 70. Then, as stated above, the fan system working fluid residing in fan system working fluid area 32 absorbs heat from the engine coolant in the radiator inlet tank 22 and the flow of the working fluid and its effects begin again.

As FIG. 5 depicts, the expander 42 and the fan system pump 64 are separated by a first internal seal 76 while a second internal seal 78 also provides a seal at the insertion area of the shaft 46 into a housing 80 of the expander and pump assembly 16. Furthermore, a shaft front bearing 82 and a shaft rear bearing 84 provide bearing surfaces upon which the shaft 46 may rotate.

FIG. 4 depicts a fan 72, which may be an electric fan that consumes relatively low power, such as 120-160 Watts, to provide airflow for the air conditioning condenser 74 when necessary. Additionally, the fan 72 may also assist in providing airflow for the fan system condenser 54. Regardless of whether the fan 72 is providing airflow for the fan system condenser 54 or the air conditioning condenser 74, the fan 72 is capable of providing or assisting in providing airflow 26 through the condensers 54, 74 such as when the vehicle 10 is not traveling in a forward direction. However the fan 72 may be used at any time to provide airflow 26 assist, even when a vehicle 10 is moving. When mounted on the front of the CRFM 14 or positioned in front of the CRFM 14, the fan 72 may supply equal or substantially equal amounts of airflow 26 to the condensers 54, 74. The fan depicted in FIG. 2 is configured as a pusher style of fan because the fan 72 pushes or blows air through the CRFM 14. Alternatively, a puller style of fan may be used. In such an arrangement, the puller style of fan would be mounted on the rear side (relative to the vehicle) of the condensers 54, 74 to pull the air through the condensers 54, 74.

While the fan system condenser 54 is depicted in FIG. 4 as being located on top of or above the air conditioner condenser 74; however, the condensers 54, 74 may be arranged in a side-by-side arrangement, for example. In such an arrangement, the condensers 54, 74 may be rotated 90 degrees from that depicted in FIG. 4. Still yet, the condensers 54, 74 may be arranged in a for-aft manner or such that the airflow 26 may pass through one of the condensers before the other. For instance, the airflow may first pass through the fan system condenser 54 and then the air conditioner condenser 74, or first the air conditioner condenser 74 and then the fan system condenser 54.

The disclosure described above presents a fan system condenser 54 to remove the portion of the heat, which is absorbed by the fan system evaporator 28, that cannot be converted to mechanical energy or power due to physical limitations in the amount of heat that can be converted into power in any heat-based power generating system. That is, some heat is not converted to useful power but may be dispersed and unused, and thus, waste heat. As such, the proposed device may be successfully applied to vehicles with a relatively large amount of space for the CRFM, or which operate in a relatively low ambient temperature environment, to support having a fan system condenser 54 in addition to an existing air conditioning condenser 74. Additionally, although not limited to vehicles, the present disclosure may be applied to those vehicles with sufficient space available to support and physically accommodate a CRFM 14. Those vehicles may include typical pickup trucks, sport utility vehicles, commercial road tractors, or larger pieces of off road equipment such as excavators, bulldozers, dirt-hauling equipment used in an off-road environment, etc.

Construction of the fan system evaporator 28 may be similar to a conventional in-tank transmission cooler or engine oil cooler. Construction of such coolers or tanks are known; however, design of the fan system evaporator 28 may take into consideration operating pressures and heat transfer requirements relative to the fan system evaporator 28. The fan system working fluid may be a hydrofluorocarbon such as R134a, or other working fluid capable of vaporization and condensation within the pressures and temperatures that the fan system experiences in operation.

Figure 6:
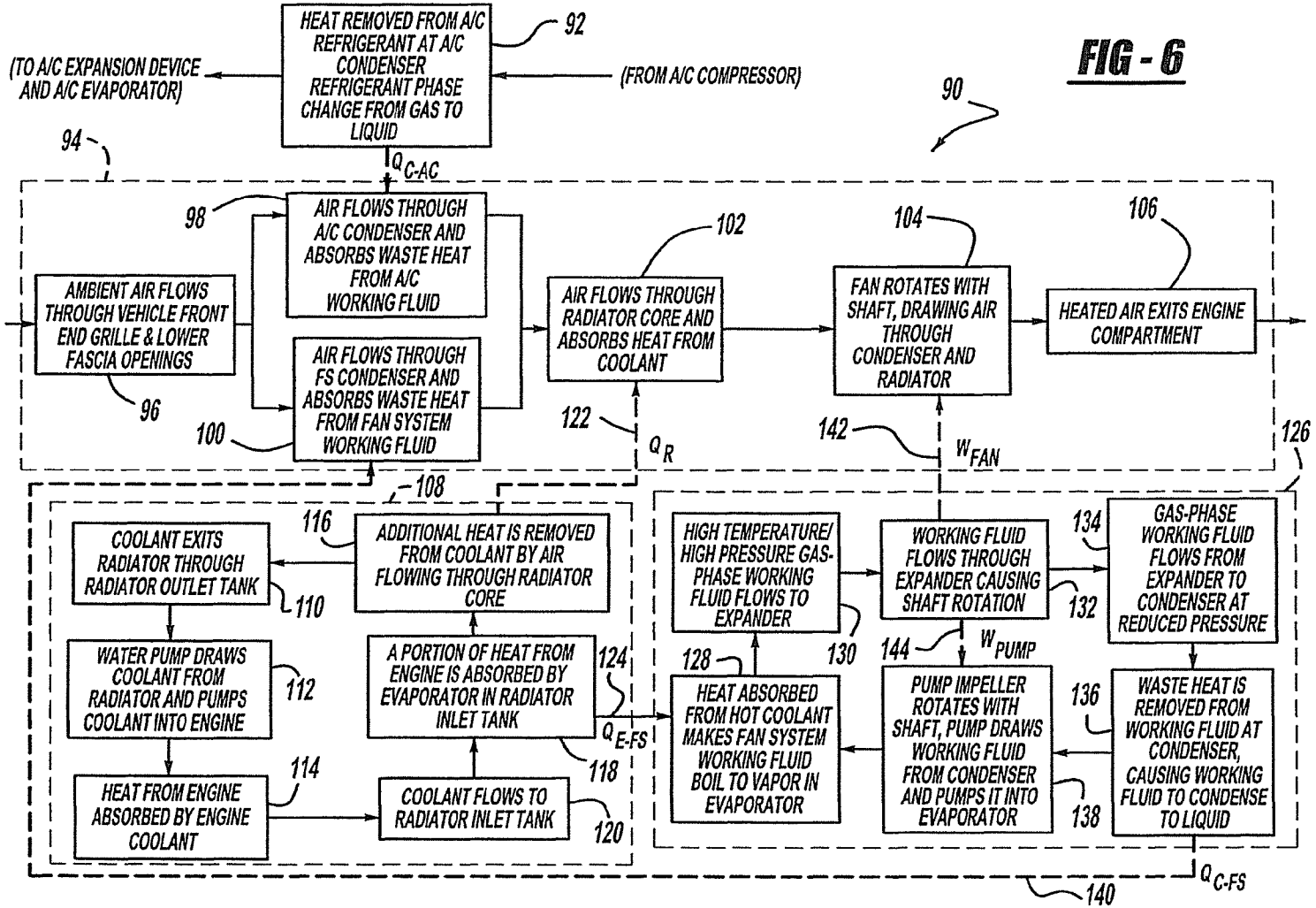
FIG. 6 is a flowchart depicting the various fluid flows of the fluid system related to the present disclosure.

FIG. 6 is a flowchart 90 depicting various fluid systems and their related mechanical components of the present disclosure. Beginning with block 92, an air-conditioning or A/C refrigerant process is represented. At block 92, heat is removed from the A/C refrigerant at the A/C condenser 74. As heat is removed from the A/C refrigerant, the A/C refrigerant changes phase from a gas to a liquid. The A/C refrigerant arrives at the A/C condenser 74 from the A/C compressor (not depicted), and after leaving the A/C condenser 74, the A/C refrigerant moves onto an A/C expansion device, such as an A/C evaporator (not depicted).

Turning now to the dashed area 94, an air process 94 is depicted. At block 96, ambient air flows through the front end of a vehicle grille and lower fascia openings and then moves through the A/C condenser 74 at block 98 and the fan system condenser 54 at block 100. At the A/C condenser 74 at block 98, waste or excess heat is removed from the A/C working fluid. Similarly, at block 100, waste or excess heat is removed from the working fluid of the fan system condenser 54. After passing through the condensers 54, 74, the airflow 26 continues through the radiator core 20 and heat is further absorbed from the engine coolant passing through the radiator 20 as represented by arrow 34 of FIG. 2 and block 102 of FIG. 6. At block 104, the mechanical engine fan 50 (not an electrically powered fan) rotates with the shaft 46 thereby drawing air through the condensers 54, 74 and radiator 20. The air continues to pass through the engine compartment and eventually the air, which has absorbed heat from the working fluids of the condensers 54, 74 and the engine coolant of the radiator 20, exits the engine compartment surrounding the engine 12, as indicated at block 106. As noted between block 92 and block 98 with $Q_{C\text{-}AC}$, heat energy passes from the A/C refrigerant in the A/C condenser into the air passing through the A/C condenser 74.

Turning now to the enclosed area indicated by the dashed area 108, processes related to engine coolant and the flow of engine coolant will be explained. Block 110 represents coolant exiting the radiator 20 through the radiator outlet tank 24. At block 112, a water pump draws coolant from the radiator 20 and pumps the coolant into the engine 12. At block 114, heat generated from combustion in the engine 12 is absorbed by the engine coolant. At block 120, the coolant flows to the radiator inlet tank 22 via the radiator inlet 21. At block 118, a quantity of heat from the engine coolant from the engine 12 is absorbed by the working fluid in the fan system evaporator 28 in the radiator inlet tank 22. At block 116, a quantity of heat is removed from the coolant by air flowing through the radiator core 20. Between block 116 and block 102, the quantity of heat removed from the engine coolant in the radiator 20 to the air flowing through the engine compartment is designated by the dashed line 122 and symbol QR. Additionally, between block 118 and block 128, the quantity of heat that is transferred from the engine coolant in the radiator inlet tank to the working fluid in the fan system evaporator 28 is represented by $Q_{E\text{-}FS}$ and dashed arrow 124.

Turning now to the enclosed area indicated by the dashed area 126, processes related to the fan system working fluid will be explained. Beginning, block 128 represents the heat absorbed by the working fluid in the fan system evaporator 28 from the hot engine coolant surrounding the fan system evaporator 28. The heat is such that it is enough to cause the fan system working fluid to boil and change phase from a liquid to a gas. In block 130, the high temperature (above 100 Celsius and 212 Fahrenheit) and high pressure gaseous phase working fluid flows from the fan system evaporator 28 to the expander 42 via the expander inlet pipe 38 and meets the expander impeller 44 to impart rotation in the expander impeller and the shaft 46 to which the impeller 44 is connected. At block 132, the working fluid flows through the expander 42, causing rotation of shaft 146. At block 134, the gaseous phase working fluid flows from the expander 42 to the fan system condenser 54 at a pressure that is lower than the pressure at which the gaseous phase working fluid entered the expander 42. At block 136, waste heat is removed from the working fluid at the fan system condenser 54 causing the working fluid to condense into a liquid phase within the condenser 54. AT block 138, the fan system pump impeller 66 of the fan system pump 64 rotates with the shaft 46. With the rotation of the pump impeller 66, the fan system working fluid is drawn from the fan system condenser 54 and pumps it into the fan system evaporator 28.

Continuing with FIG. 6, from block 136 to block 100 a dashed line 140 is indicative of a quantity of heat $Q_{C\text{-}FS}$ that is transferred from the working fluid within the fan system condenser 54 to the air passing through the fan system condenser 54. Additionally, an energy transfer in the form of mechanical work or power $W_{FAN}$ is indicated from block 132 to block 104 by dashed line 142. More specifically, the energy transfer is the rotation of the shaft 46, caused by the expander impeller 44 being rotated by the gaseous working fluid, and the subsequent rotation of the fan 50. Another energy transfer in the form of mechanical work or power $W_{PUMP}$ is indicated between block 132 and block 138 and is indicated by dashed line 144. More specifically, the energy transfer is the rotation of the pump impeller 66 which rotates the pump 64 and causes the fan system working fluid to be drawn from the fan system condenser 54 and pumped into the fan system evaporator 28.

Then, as presented above, the disclosure relates to an apparatus to drive a mechanical cooling fan 50, different from an electrical cooling fan 72, which may supplement or act in concert with a mechanical cooling fan 50. As such, the apparatus may employ a radiator 20 for retaining engine coolant, the radiator 20 having a radiator inlet tank 22, a fan system evaporator 28 residing within the radiator inlet tank 22, the fan system evaporator 28 retaining a working fluid different from the engine coolant, and an expander 42 having an impeller 44 for receiving the working fluid from the fan system evaporator 28 to impart rotation in the impeller 44 to drive the cooling fan 50. The apparatus may further employ a shaft 46, the shaft 46 connected to the impeller 44 and the cooling fan 50 to transfer energy to the cooling fan 50, and a working fluid pump 64, also called a fan system pump 64, the pump 64 driven by rotation of the shaft 46. Furthermore, the apparatus may utilize a fan system condenser 54, the fan system condenser 54 for receiving the working fluid from the expander 42 to effect a phase change in the working fluid. Still yet, as the apparatus may employ a shaft 46, the shaft 46 may be connected to the impeller 44 and the cooling fan 50 to transfer energy to the cooling fan 50, a working fluid pump 64, the pump 64 driven by the shaft 46, and a fan system condenser 54, the fan system condenser 54 for receiving the working fluid from the expander 42 to effect a phase change in the working fluid. The fan 50 may draw air through the fan system condenser 54 and the radiator 20, which may be arranged in series from an airflow perspective.

In another configuration, an apparatus to drive a cooling fan 50 may employ a radiator 20 having a radiator inlet tank 22 attached (e.g. welded or brazed) at a first end of the radiator 20, the radiator inlet tank 22 filled with an engine coolant, a fan system evaporator 28 disposed inside the radiator inlet tank 22, the fan system evaporator 28 containing a liquid working fluid capable of absorbing heat from the engine coolant and becoming a gaseous working fluid, a gas expander 42 with an impeller 44 to receive the gaseous working fluid from the fan system evaporator 28, a fan system condenser 54 to receive the gaseous working fluid from the gas expander 42 and condense the gaseous working fluid to form a liquid working fluid, a pump 64 to receive the liquid working fluid from the fan system condenser 54 and pump the liquid working fluid into the fan system condenser 54, and a shaft 46 that is driven by the gas expander 42 to drive the cooling fan 50. The apparatus may employ an air conditioning condenser 74, wherein the cooling fan 50 draws air through the fan system condenser 54 and the air conditioning condenser 74. An electric cooling fan 72 may be arranged such that the electric cooling fan 72 will push air through the fan system condenser 54 and the air conditioning condenser 74. The gas expander 42 and the pump 64 may be contained within a common housing 80 and mounted to the shaft 46. The fan system evaporator 28 may be completely disposed inside the radiator inlet tank 22. The shaft 46 that drives the cooling fan 50 also drives the pump impeller 66 of the pump 64.

In yet another configuration, an apparatus to drive a cooling fan 50 may employ a radiator 20 having a radiator inlet tank 22 attached at a first end of the radiator 20, the radiator inlet tank 22 filled with an engine coolant, a fan system evaporator 28 may be entirely contained inside the radiator inlet tank 22, the fan system evaporator 28 may contain a liquid working fluid capable of absorbing heat from the engine coolant and becoming a gaseous working fluid. A gas expander 42 with an impeller 44 may receive the gaseous working fluid from the fan system evaporator 28. A fan system condenser 54 may receive the gaseous working fluid from the gas expander 42 and condense the gaseous working fluid to form a liquid working fluid. A pump 64 may receive the liquid working fluid from the fan system condenser 54 and pump the liquid working fluid into the fan system condenser 54. An air conditioning condenser 74 may be arranged such that the cooling fan 50 may draw air through the fan system condenser 54 and the air conditioning condenser 74. A shaft 46 may be coupled to the cooling fan 50 and the pump 64. The shaft 46 may be driven by the gas expander 42 such that the gas expander 42 and the pump 64 are contained within a common housing 80 and are mounted to the shaft 46.

The electric cooling fan 72 may be arranged such that the electric cooling fan 72 will push air through the fan system condenser 54 and the air conditioning condenser 74, as opposed to pulling the air. An air-conditioning condenser 74 may be positioned relative to the fan system condenser 54 such that the cooling fan 50 is positioned or directed to blow air through both condensers 54, 74 in a parallel or in a serial fashion (as illustrated in phantom in FIG. 2) with respect to a the airflow.

There are numerous advantages to the present disclosure. First, the device utilizes heat available in the engine coolant as an energy source for a Rankine Cycle system to provide power for the engine cooling fan. Vehicles that need high power cooling fans typically generate 80 to 100 kW of heat as high load conditions that must be rejected through the radiator. Conversion of about one percent of that heat energy into mechanical power would be sufficient to power a high power cooling fan required by such a vehicle. Second, there is no negative impact on vehicle fuel economy because the power source for the fan is waste heat from the engine and not from an accessory drive pulley as in the case of engine driven and electrically driven fans. Third, self-modulation of fan speed is realized since the fan speed generated is proportional to the fan speed required based on the quantity of heat or temperature of the engine coolant. That is, as the demand for additional fan speed increases as the engine coolant temperature rises, the amount of heat available to power the cooling fan also rises, thus fan speed will increase naturally as the coolant temperature increases.

A fourth advantage is that the cooling system and fan system is self-contained. More specifically, because the energy source for the fan, which is waste heat from the engine coolant, and the means of delivering that energy to the fan, such as the plumbing and expander, can all be contained within the CRFM. A fifth advantage is that there is no FEAD impact since power is not obtained from any accessory drive component. A sixth advantage is that the fan system has a high efficiency since the device powering the fan is mounted to the fan shroud, this allows for minimal fan to shroud tip clearance. A seventh advantage is that the device is applicable to transversely mounted engines in vehicles, such as front wheel drive vehicles, because the device is not powered by the FEAD. An eighth advantage is that the overall cost of the device will be lower than a hydraulic fan drive system and lower than a brushless motor driven fan system. A ninth advantage is that the cooling fan 50, also know as the mechanical cooling fan, can draw air through both the fan system condenser and the air conditioning condenser, whether such condensers are arranged such that air is drawn through them in a serial fashion (one after the other) or a parallel fashion. Utilization of the cooling fan in such a way contributes to the efficient use of a single mechanical cooling fan. Similarly, a similar efficiency exists with arrangement of an electric cooling fan located on an opposite side of the condensers as the mechanical cooling fan. The electric cooling fan may receive power from a vehicle battery.

What is claimed is:

1. A cooling fan apparatus, the apparatus comprising:
a radiator retaining engine coolant, the radiator having a radiator inlet tank;
a cooling fan directing air flow through the radiator;
a fan system evaporator residing within the radiator inlet tank, the fan system evaporator retaining a working fluid different from the engine coolant; and
an expander receiving the working fluid from the fan system evaporator to impart rotation to an impeller of the expander to drive the cooling fan.

2. The apparatus of claim 1, further comprising:
a shaft, the shaft connected to the impeller and the cooling fan to transfer energy to the cooling fan; and
a working fluid pump, the pump driven by the shaft.

3. The apparatus of claim 1, further comprising:
a fan system condenser, the fan system condenser receiving the working fluid from the expander to effect a phase change in the working fluid; and
a pump, the pump receiving the working fluid from the fan system condenser and pumping the working fluid into the fan system evaporator.

4. The apparatus of claim 1, further comprising:

a shaft, the shaft connected to the impeller and the cooling fan to transfer energy to the cooling fan;

a fan system condenser, the fan system condenser receiving the working fluid from the expander to effect a phase change in the working fluid; and a working fluid pump, the pump driven by the shaft move the working fluid into the fan system evaporator.

5. The apparatus of claim 1, wherein the fan draws air through the fan system condenser and the radiator.

6. A cooling fan apparatus, the apparatus comprising:

a radiator having a radiator inlet tank attached at a first end of the radiator, the radiator inlet tank filled with an engine coolant;

a cooling fan directing air flow through the radiator;

a fan system evaporator disposed inside the radiator inlet tank, the fan system evaporator containing a liquid working fluid capable of absorbing heat from the engine coolant such that the liquid working fluid becomes a gaseous working fluid;

a gas expander receiving the gaseous working fluid from the fan system evaporator;

a fan system condenser receiving the gaseous working fluid from the gas expander and condensing the gaseous working fluid to form the liquid working fluid;

a pump receiving the liquid working fluid from the fan system condenser and pumping the liquid working fluid into the fan system evaporator; and a shaft that is driven by the gas expander to drive the cooling fan.

7. The apparatus of claim 6, further comprising:

an air conditioning condenser, wherein the cooling fan draws air through the fan system condenser and the air conditioning condenser.

8. The apparatus of claim 7, further comprising:

an electric cooling fan arranged such that the electric cooling fan pushes air through the fan system condenser and the air conditioning condenser.

9. The apparatus of claim 8, wherein the gas expander and the pump are contained within a common housing and mounted to the shaft.

10. The apparatus of claim 6, wherein the fan system evaporator is completely disposed inside the radiator inlet tank.

11. The apparatus of claim 6, wherein the shaft that drives the cooling fan also drives the pump.

12. A cooling fan apparatus, the apparatus comprising:

a radiator having a radiator inlet tank attached at a first end of the radiator, the radiator inlet tank filled with an engine coolant;

a cooling fan directing air flow through the radiator;

a fan system evaporator disposed inside the radiator inlet tank, the fan system evaporator containing a liquid working fluid capable of absorbing heat from the engine coolant such that the liquid working fluid becomes a gaseous working fluid;

a gas expander receiving the gaseous working fluid from the fan system evaporator;

a fan system condenser receiving the gaseous working fluid from the gas expander and condensing the gaseous working fluid to form the liquid working fluid;

a pump receiving the liquid working fluid from the fan system condenser and pumping the liquid working fluid into the fan system evaporator;

an air conditioning condenser, wherein the cooling fan directs air through the fan system condenser and the air conditioning condenser; and a shaft coupled to the cooling fan and the pump, the shaft driven by the gas expander.

13. The apparatus of claim 12, further comprising:

an electric cooling fan arranged such that the electric cooling fan will push air through the fan system condenser and the air conditioning condenser.

14. The apparatus of claim 12, wherein:

the air conditioning condenser is positioned relative to the fan system condenser such that the cooling fan directs air through both condensers in a parallel fashion.

15. The apparatus of claim 12, wherein:

the air-conditioning condenser is positioned relative to the fan system condenser such that the cooling fan directs air through both condensers in a serial fashion.

16. The apparatus of claim 12, wherein the gas expander and the pump are contained within a common housing and mounted to the shaft.

17. The apparatus of claim 16, wherein the fan system evaporator is completely disposed inside the radiator inlet tank.

18. The apparatus of claim 12, wherein the fan system evaporator is completely disposed inside the radiator inlet tank.

* * * * *

UNITED STATES PATENT AND TRADEMARK OFFICE

CERTIFICATE OF CORRECTION

PATENT NO. : 8,327,654 B2
APPLICATION NO. : 12/077180
DATED : December 11, 2012
INVENTOR(S) : Dwayne Robert Taylor It is certified that error appears in the above-identified patent and that said Letters Patent is hereby corrected as shown below:

Col. 7, line 62, delete "a"

Col. 9, line 7, claim 4, after "shaft" insert -- to --

Signed and Sealed this
Twelfth Day of March, 2013

Teresa Stanek Rea
*Acting Director of the United States Patent and Trademark Office*